US010191421B2

(12) United States Patent
Fujii et al.

(10) Patent No.: US 10,191,421 B2
(45) Date of Patent: Jan. 29, 2019

(54) FUSER AND IMAGE APPARATUS HAVING THE SAME

(71) Applicant: BROTHER KOGYO KABUSHIKI KAISHA, Nagoya-shi, Aichi-ken (JP)

(72) Inventors: Yasumasa Fujii, Anjo (JP); Hisashi Tsukawaki, Aichi (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/825,764

(22) Filed: Nov. 29, 2017

(65) Prior Publication Data

US 2018/0150005 A1 May 31, 2018

(30) Foreign Application Priority Data

Nov. 30, 2016 (JP) ..... 2016-232835

(51) Int. Cl.
*G03G 15/20* (2006.01)
*G03G 15/00* (2006.01)

(52) U.S. Cl.
CPC ..... *G03G 15/2053* (2013.01); *G03G 15/2028* (2013.01); *G03G 15/657* (2013.01); *G03G 2215/2035* (2013.01)

(58) Field of Classification Search
CPC ..... G03G 15/2053; G03G 15/2028; G03G 2215/2035; G03G 15/657
USPC ..... 399/320
See application file for complete search history.

(56) References Cited

U.S. PATENT DOCUMENTS

| | | | | |
|---|---|---|---|---|
| 7,142,803 | B2 | 11/2006 | Koyama et al. | |
| 8,280,291 | B2 | 10/2012 | Yamamoto et al. | |
| 9,874,838 | B1 * | 1/2018 | Cao | G03G 15/2042 |
| 2010/0202809 | A1 | 8/2010 | Shinshi et al. | |
| 2010/0290823 | A1 | 11/2010 | Okabe et al. | |
| 2010/0296849 | A1 | 11/2010 | Yamamoto | |
| 2011/0076071 | A1 | 3/2011 | Yamaguchi et al. | |
| 2013/0164058 | A1 | 6/2013 | Suzuki et al. | |
| 2015/0261155 | A1 | 9/2015 | Yoshiura et al. | |

FOREIGN PATENT DOCUMENTS

| | | | |
|---|---|---|---|
| JP | 2009-86391 | A | 4/2009 |
| JP | 2010-181821 | A | 8/2010 |
| JP | 2010-266802 | A | 11/2010 |
| JP | 2010-271623 | A | 12/2010 |
| JP | 2011-70070 | A | 4/2011 |

(Continued)

OTHER PUBLICATIONS

Related U.S. Appl. No. 15/627,784, filed Jun. 20, 2017.
Office Action (Notice of Allowance) issued in related U.S. Appl. No. 15/627,784, dated Feb. 13, 2018.

*Primary Examiner* — Susan S Lee
(74) *Attorney, Agent, or Firm* — Merchant & Gould P.C.

(57) ABSTRACT

A fuser includes an endless belt, a base member, a sheet member including a first section pinched between an inner surface of the endless belt and the base member, a second section extending from an end of the first section, and a third section extending from another end of the first section, and a stationary member configured to pinch the second and third sections of the sheet member with a base member, the stationary member having a claw configured to stick in the second and third sections of the sheet member.

20 Claims, 10 Drawing Sheets

(56) References Cited

FOREIGN PATENT DOCUMENTS

| | | | |
|---|---|---|---|
| JP | 2012-145633 | A | 8/2012 |
| JP | 2013-152435 | A | 8/2013 |
| JP | 2014-145858 | A | 8/2014 |
| JP | 2016-33636 | A | 3/2016 |

* cited by examiner

FUSER AND IMAGE APPARATUS HAVING THE SAME

CROSS-REFERENCE TO RELATED APPLICATION

This application claims priority under 35 U.S.C. § 119 from Japanese Patent Application No. 2016-232835 filed on Nov. 30, 2016. The entire subject matter of the application is incorporated herein by reference.

BACKGROUND

Technical Field

Aspects of the present disclosure are related to a fuser to thermally fix a developer image on a sheet and an image forming apparatus having the fuser.

Related Art

Heretofore, a fuser has been known that includes a nip member configured to be held in pressure contact with a pressurizing rotator via a fixing belt thereby forming a nip portion. The nip member is covered with a sheet member (e.g., a low-friction sheet) along a circumferential direction of the nip member. The sheet member has an overlapping section at which two end portions of the sheet member overlap each other. The overlapping section is pinched between a plate-shaped member and the nip member. Thereby, the sheet member is fixedly fastened to the nip member.

SUMMARY

According to aspects of the present disclosure, a fuser is provided, which includes an endless belt, a base member disposed inside a space surrounded by the endless belt, a sheet member including a first section pinched between an inner surface of the endless belt and the base member, a second section extending from an end of the first section, and a third section extending from another end of the first section, and a stationary member configured to pinch the second section and the third section of the sheet member with the base member, the stationary member having a claw configured to stick in the second section and the third section of the sheet member.

According to aspects of the present disclosure, further provided is a fuser that includes an endless belt, a base member disposed inside a space surrounded by the endless belt, a sheet member including a first section pinched between an inner surface of the endless belt and the base member, a second section extending from an end of the first section, the second section being locked by a locking section of the base member, and a third section extending from another end of the first section, and a stationary member configured to pinch the third section of the sheet member with the base member, the stationary member having a claw configured to stick in the third section of the sheet member.

According to aspects of the present disclosure, further provided is an image forming apparatus that includes a process unit configured to form a developer image on a recording sheet, and a fuser configured to fix the developer image onto the recording sheet. The fuser includes an endless belt, a base member disposed inside a space surrounded by the endless belt, a sheet member including a first section pinched between an inner surface of the endless belt and the base member, a second section extending from an end of the first section, and a third section extending from another end of the first section, and a stationary member configured to pinch the second section and the third section of the sheet member with the base member, the stationary member having a claw configured to stick in the second section and the third section of the sheet member.

According to aspects of the present disclosure, further provided is an image forming apparatus that includes a process unit configured to form a developer image on a recording sheet, and a fuser configured to fix the developer image onto the recording sheet. The fuser includes an endless belt, a base member disposed inside a space surrounded by the endless belt, a sheet member including a first section pinched between an inner surface of the endless belt and the first surface of the base member, a second section extending from an end of the first section, the second section being locked by a locking section of the base member, and a third section extending from another end of the first section, and a stationary member configured to pinch the third section of the sheet member with the base member, the stationary member having a claw configured to stick in the third section of the sheet member.

BRIEF DESCRIPTION OF THE ACCOMPANYING DRAWINGS

DETAILED DESCRIPTION

It is noted that various connections are set forth between elements in the following description. It is noted that these connections in general and, unless specified otherwise, may be direct or indirect and that this specification is not intended to be limiting in this respect.

Hereinafter, an illustrative embodiment according to aspects of the present disclosure will be described with reference to the accompanying drawings. In the following description, directions related to a laser printer 1 will be defined on the basis of orientations indicated by arrows in FIG. 1. For instance, an up-to-down or down-to-up direction in FIG. 1 may be referred to as a "vertical direction." A viewer's right-hand side, left-hand side, nearer side, and farther side in FIG. 1 may be referred to as front, rear, left, and right, respectively. A front-to-rear or rear-to-front direction may be referred to as a "front-to-rear direction." A left-to-right or right-to-left direction may be referred to as a "left-to-right direction."

Figure 1:
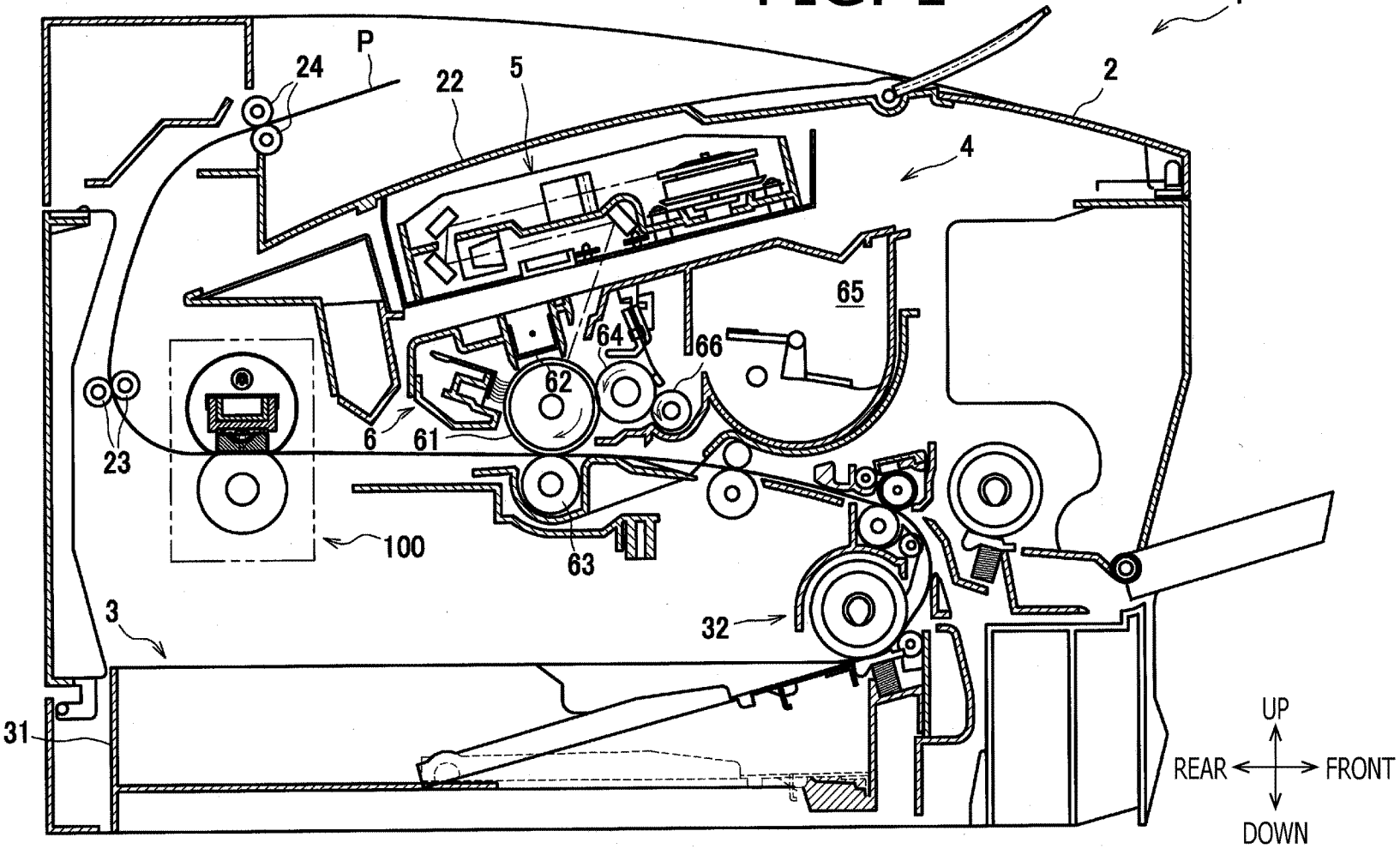
FIG. 1 is a cross-sectional side view of an image forming apparatus having a fuser in an illustrative embodiment according to one or more aspects of the present disclosure.

As shown in FIG. 1, the laser printer 1 includes a housing 2, a sheet feeder 3, a process unit 4, and a fuser 100. The sheet feeder 3 is configured to feed a sheet P. The process unit 4 is configured to form a toner image on the sheet P fed by the sheet feeder 3.

The sheet feeder 3 is disposed at a lower portion in the housing 2. The sheet feeder 3 includes a feed tray 31 and a sheet feeding mechanism 32. The feed tray 31 is configured to support sheets P placed thereon. The sheet feeding mechanism 32 is configured to feed the sheets P placed on the feed tray 31 toward the process unit 4.

The process unit 4 is disposed inside the housing 2. The process unit 4 includes an exposure device 5, a process cartridge 6, and a transfer roller 63.

The exposure device 5 is disposed at an upper portion in the housing 2. The exposure device 5 is configured to emit laser light toward a below-mentioned photoconductive drum 61 and perform high-speed scanning of a surface of the photoconductive drum 61 with the laser light.

The process cartridge 6 is disposed below the exposure device 5. The process cartridge 6 is detachably attached to the housing 2. The process cartridge 6 includes a photoconductive drum 61, a charger 62, a toner container 65, a supply roller 66, and a development roller 64. The photoconductive drum 61 is configured such that an electrostatic latent image is formed thereon. The toner container 65 is configured to store toner therein. The supply roller 66 is configured to supply the toner stored in the toner container 65 to the photoconductive drum 61.

In the process cartridge 6, the charger 62 evenly charges the surface of the rotating photoconductive drum 61. The exposure device 5 emits laser light toward the surface of the photoconductive drum 61 thereby exposing the surface of the photoconductive drum 61. Thus, an electrostatic latent image based on image data is formed on the surface of the photoconductive drum 61.

Subsequently, the development roller 64 driven to rotate supplies toner to the electrostatic latent image on the photoconductive drum 61. Thereby, a toner image is formed on the surface of the photoconductive drum 61. Afterward, when a sheet P passes between the photoconductive drum 61 and the transfer roller 63, the toner image carried on the surface of the photoconductive drum 61 is transferred onto the sheet P by an attractive force from the transfer roller 63.

The fuser 100 is disposed at the back of the process cartridge 6. The image transferred on the sheet P is thermally fixed onto the sheet P when passing through the fuser 100. The sheet P with the toner image thermally fixed thereon is discharged onto a discharge tray 22 by conveyance roller 23 and 24.

Figure 2:
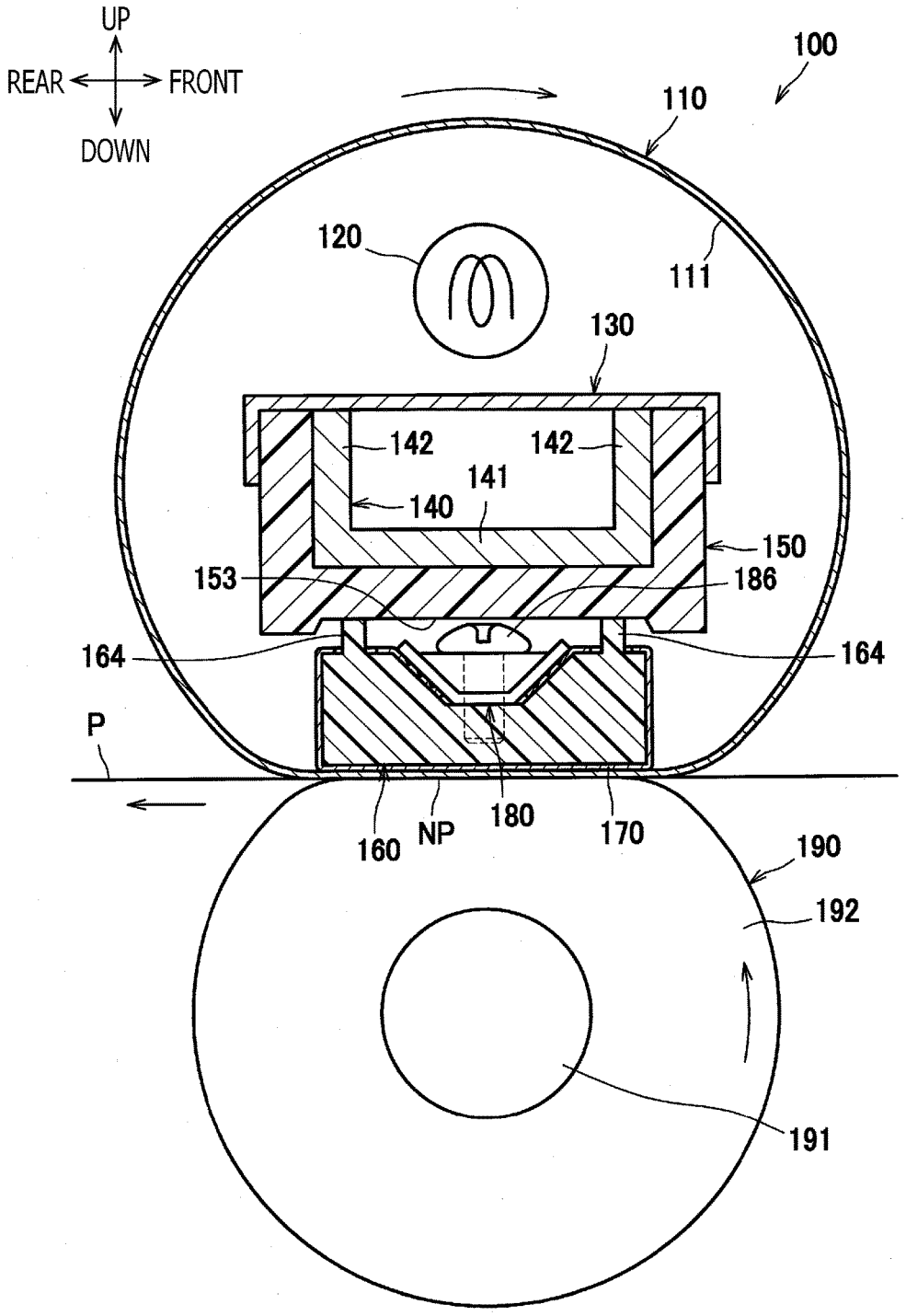
FIG. 2 is a cross-sectional side view partially showing the fuser in the illustrative embodiment according to one or more aspects of the present disclosure.

As shown in FIG. 2, the fuser 100 includes an endless belt 110, a halogen lamp 120, a reflector 130, a stay 140, a heat insulator 150, a base member 160, a sheet member 170, a stationary member 180, and a pressurizing roller 190.

The endless belt 110 is a heat-resistant flexible belt. The endless belt 110 includes a base tube made of metal (e.g., stainless steel), and a coating layer of fluorine resin formed on a circumferential surface of the base tube. The endless belt 110 is revolvably supported at both end portions thereof in the left-to-right direction, by side guides (not shown). The halogen lamp 120, the reflector 130, the stay 140, the heat insulator 150, the base member 160, and the sheet member 170 are disposed on an inner side of the endless belt 110. In other words, the halogen lamp 120, the reflector 130, the stay 140, the heat insulator 150, the base member 160, and the sheet member 170 are disposed inside a space surrounded by the endless belt 110. A width of the endless belt 110 in the left-to-right direction (i.e., a direction of a rotational axis of the endless belt 110) is smaller than a width, in the left-to-right direction, of each of internal member (e.g., the halogen lamp 120, the reflector 130, the stay 140, the heat insulator 150, the base member 160, and the sheet member 170) disposed on the inner side of the endless belt 110.

The halogen lamp 120 is a heat source to heat the endless belt 110. The halogen lamp 120 is spaced apart at a particular distance from an inner circumferential surface 111 of the endless belt 110. The halogen lamp 120 is elongated in the left-to-right direction.

The reflector 130 is configured to reflect heat radiated from the halogen lamp 120 toward the inner circumferential surface 111 of the endless belt 110. The reflector 130 is spaced apart at a particular distance from the halogen lamp 120. The reflector 130 has a surface layer made of metal such as aluminum. The reflector 130 as a whole may be made of metal such as aluminum.

The stay 140 is disposed below the reflector 130. The stay 140 includes a base section 141 and two flange sections 142. The base section 141 is elongated in the left-to-right direction. Each flange section 142 extends upward from a corresponding one of both end portions of the base section 141 in the front-to-rear direction. In other words, one flange section 142 extends upward from a front end portion of the base section 141, and the other flange section 142 extends upward from a rear end portion of the base section 141. An upper end of each flange section 142 is in contact with a lower surface of the reflector 130. The stay 140 has a higher stiffness than a stiffness of the reflector 130. For instance, the stay 140 may be made of metal such as steel.

The heat insulator 150 is disposed below the reflector 130 to cover the stay 140 from beneath. A lower surface of the heat insulator 150 is formed to have a recessed portion 153 that is recessed upward. The heat insulator 150 is made of material having a heat conductivity lower than a heat conductivity of the stay 140. For instance, the heat insulator 150 may be made of heat-resistant resin such as liquid crystal polymer.

The base member 160 is configured to form a nip portion NP between the endless belt 110 and the pressurizing roller 190 by holding (pinching) the endless belt 110 between the base member 160 and the pressurizing roller 190. The sheet member 170 is disposed on an outer circumferential surface of the base member 160.

The stationary member 180 is disposed on an upper surface of the base member 160. The stationary member 180 is configured to fixedly fasten the sheet member 170 by holding (pinching) end portions of the sheet member 170 between the stationary member 180 and the base member 160. The stationary member 180 is fixedly fitted onto an upper surface portion of the base member 160.

The pressurizing roller 190 is driven to rotate by a driving force from a motor (not shown) provided inside the housing 2. When driven to rotate, the pressurizing roller 190 revolves the endless belt 110 by a frictional force generated between the pressurizing roller 190 and the endless belt 110. When the sheet P with the toner image transferred thereon passes between the pressurizing roller 190 and the heated endless belt 110, the toner image is thermally fixed.

The pressurizing roller 190 is configured to convey a sheet P between the pressurizing roller 190 and the base member 160 via the endless belt 110. The pressurizing roller 190 is disposed under the base member 160 to hold (pinch) the endless belt 110 with the base member 160. The pressurizing roller 190 includes a metal shaft 191 and a roller main body 192. The roller main body 192 is a resilient body provided around a circumference of the shaft 190. The pressurizing roller 190 and the base member 160 are disposed in a state where one of them is pressed by the other.

The base member 160 may be made of resin. For instance, the base member 160 may be made of heat-resistant resin such as liquid crystal polymer. The base member 160 is formed substantially in the shape of a rectangular plate elongated in the left-to-right direction. The base member 160 is disposed between the heat insulator 150 and the endless belt 110, on the inner side of the endless belt 110 (i.e., inside the space surrounded by the endless belt 110).

Figure 3:
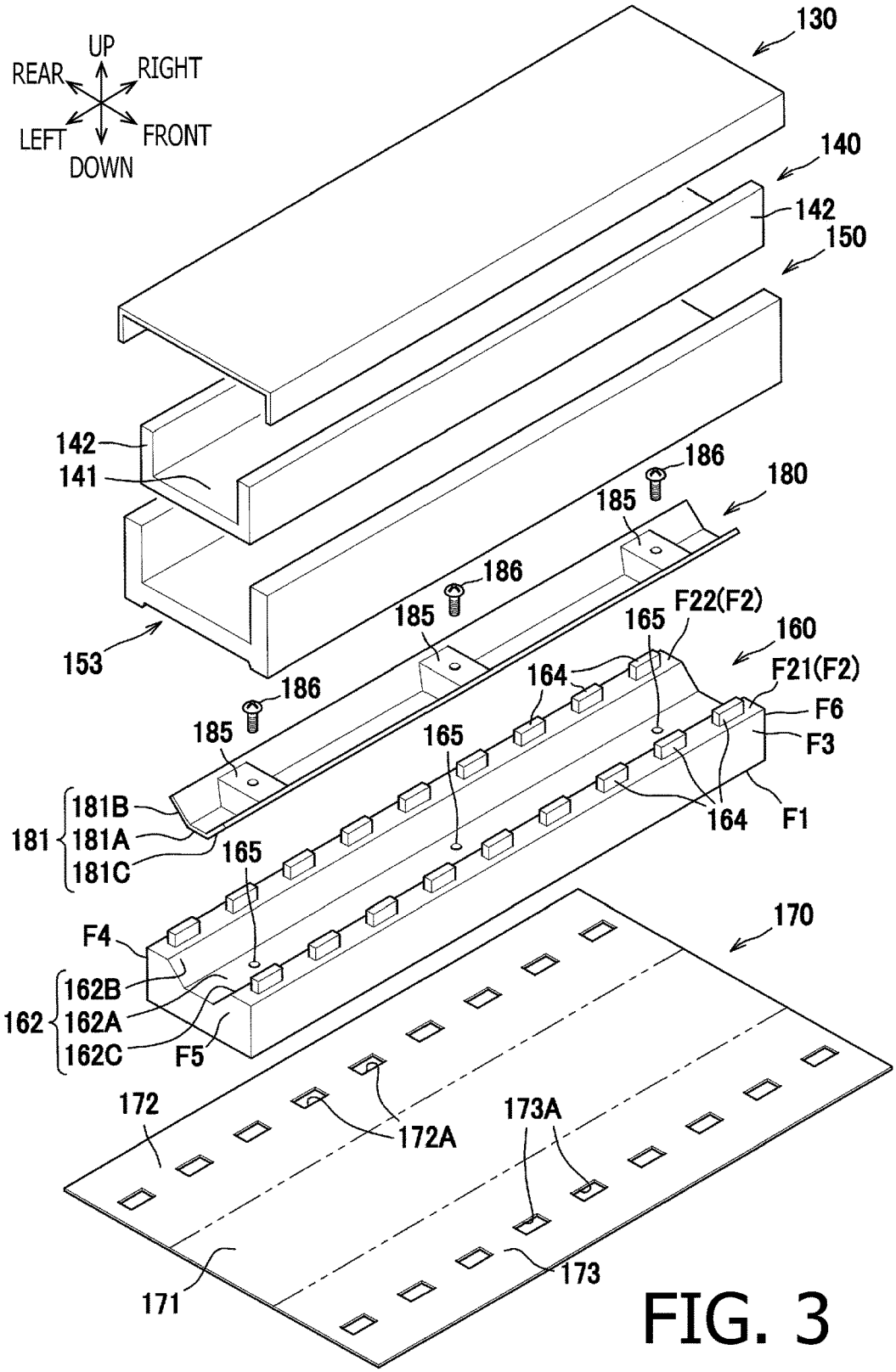
FIG. 3 is an exploded perspective view of the fuser including a reflector, a stay, a heat insulator, a stationary member, a base member, and a sheet member, in the illustrative embodiment according to one or more aspects of the present disclosure.

As shown in FIG. 3, the base member 160 has a first surface F1, a second surface F2, a third surface F3, a fourth surface F4, a fifth surface F5, and a sixth surface F6. The first surface F1 is a surface to hold (pinch) the sheet member 170 with the endless belt 110. The first surface F1 and the second surface F2 are perpendicular to the vertical direction. The second surface F2 is placed in a position higher than the first surface F1. Specifically, the second surface F2 is substantially opposed to the first surface F1 in the vertical direction. At a middle portion of the second surface F2 in the front-to-rear direction, a recessed section 162 is formed. The recessed section 162 is recessed downward from the second surface F2. The recessed section 162 has a longitudinal direction along the left-to-right direction.

The third surface F3 is perpendicular to the front-to-rear direction. The third surface F3 is formed to connect a front end of the first surface F1 with a front end of the second surface F2. The fourth surface F4 is perpendicular to the front-to-rear direction. The fourth surface F4 is formed to connect a rear end of the first surface F1 with a rear end of the second surface F2.

The fifth surface F5 is perpendicular to the left-to-right direction. The fifth surface F5 is formed to connect respective left ends of the first surface F1, the second surface F2, the recessed section 162, the third surface F3, and the fourth surface F4. The sixth surface F6 is perpendicular to the left-to-right direction. The sixth surface F6 is formed to connect respective right ends of the first surface F1, the second surface F2, the recessed section 162, the third surface F3, and the fourth surface F4.

The recessed section 162 has a bottom surface 162A, a first inclined surface 162B, and a second inclined surface 162C. The first inclined surface 162B extends from a rear end of the bottom surface 162A toward the second surface F2. The second inclined surface 162C extends from a front end of the bottom surface 162A toward the second surface F2. The bottom surface 162A has three holes 165 formed substantially in a center position of the bottom surface 162A in the front-to-rear direction. The three holes 165 are arranged at regular intervals in the left-to-right direction.

The bottom surface 162A is perpendicular to the vertical direction. The bottom surface 162A is formed to extend from an end to the other end of the base member 160 in the left-to-right direction. Each of the three holes 165 is configured to engage with one of screws 186 for fixedly fastening the stationary member 180.

The first inclined surface 162B is inclined relative to the bottom surface 162A. The first inclined surface 162B is formed to extend from an end to the other end of the base member 160 in the left-to-right direction. Likewise, the second inclined surface 162C is inclined relative to the bottom surface 162A. The second inclined surface 162C is formed to extend from an end to the other end of the base member 160 in the left-to-right direction. Specifically, the first inclined surface 162B extends obliquely toward an upper rear side from the rear end of the bottom surface 162A. Further, the first inclined surface 162B is inclined relative to a fitting direction in which the stationary member 180 is fitted onto the base member 160 (i.e., relative to the vertical direction along which the base member 160 and the stationary member 180 are arranged). The second inclined surface 162C extends obliquely toward an upper front side from the front end of the bottom surface 162A. Further, the second inclined surface 162C is inclined relative to the fitting direction in which the stationary member 180 is fitted onto the base member 160 (i.e., relative to the vertical direction along which the base member 160 and the stationary member 180 are arranged).

On a front section F21 of the second surface F2 that is positioned ahead of the recessed section 162, a plurality of projections 164 are formed. Each projection 164 protrudes upward from the second surface F2, and is formed in the shape of a rectangular parallelepiped elongated in the left-to-right direction. The plurality of projections 164 are arranged spaced apart from each other in the left-to-right direction.

On a rear section F22 of the second surface F2 that is positioned rearward of the recessed section 162, a plurality of projections 164 are formed. Each projection 164 protrudes upward from the second surface F2, and is formed in the shape of a rectangular parallelepiped elongated in the left-to-right direction. The plurality of projections 164 are arranged spaced apart from each other in the left-to-right direction. Upper ends of the projections 164, which are formed on the front and rear sections F21 and F22 of the second surface F2, are in contact with the heat insulator 150.

The sheet member 170 may be a woven fabric made by impregnating glass fiber cloth with low-friction material such as PTFE ("PTFE" is an abbreviated form of "polytetrafluoroethylene"). The sheet member 170 is placed inside the space surrounded by the endless belt 110, to be in contact with the endless belt 110. Further, the sheet member 170 is disposed around and along the outer circumference of the base member 160. For instance, the sheet member 170 may have a thickness of 0.05 to 0.55 mm. The sheet member 170 may be a sheet extrusion-molded from resin (e.g., polyimide), instead of a woven fabric.

The sheet member 170 only needs to be configured such that a kinetic friction force between the sheet member 170 and the endless belt 110 is less than a kinetic friction force between the base member 160 and the endless belt 110. Thus, as long as the above requirement is satisfied, the sheet member 170 may be made of any material, and whether to use a lubricant or what kind of lubricant is to be used for the sheet member 170 may be determined appropriately as needed.

The sheet member 170 is a rectangular sheet-shaped member. The sheet member 170 includes a first section 171, a second section 172, and a third section 173. The first section 171 is pinched between the endless belt 110 and the first surface F1. The second section 172 extends from a rear end of the first section 171. The third section 173 extends from a front end of the first section 171. In FIG. 3, a boundary between the first section 171 and each of the second and third sections 172 and 173 is indicated by an alternate long and two short dashes line for the sake of explanatory convenience.

The second section 172 has a plurality of first escape holes 172A corresponding to the plurality of projections 164 formed on the rear section F22 of the second surface F2. Each first escape hole 172A is a rectangular hole formed to enable a corresponding one of the projections 164 to loosely fit therein.

The third section 173 has a plurality of second escape holes 173A corresponding to the plurality of projections 164 formed on the front section F21 of the second surface F2. Each second escape hole 173A is a rectangular hole formed to enable a corresponding one of the projections 164 to loosely fit therein.

Figure 4:
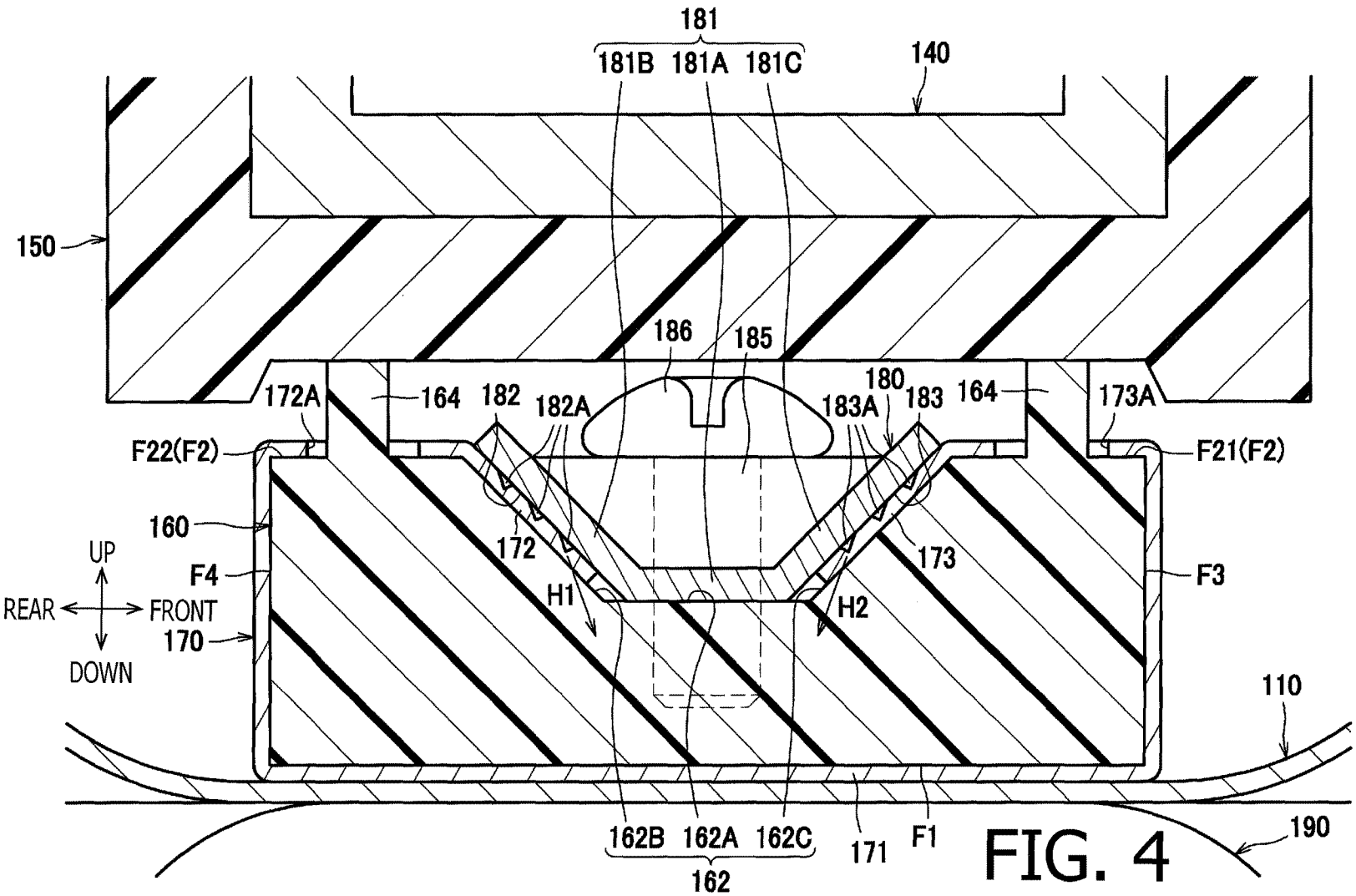
FIG. 4 is an enlarged cross-sectional side view of the base member and its peripheral elements shown in FIG. 2, in the illustrative embodiment according to one or more aspects of the present disclosure.

As shown in FIG. 4, an end portion of the second section 172 of the sheet member 170 is put into the recessed section 162 of the base member 160, and is fixedly fastened to the base member 160 by the stationary member 180. An end portion of the third section 173 of the sheet member 170 is put into the recessed section 162 of the base member 160, and is fixedly fastened to the base member 160 by the stationary member 180. The stationary member 180 is fixedly fastened to the base member 160 via the screws 186.

Specifically, in a state where the sheet member 170 is fixedly fastened to the base member 160, the first section 171 of the sheet member 170 is in contact with the first surface F1. Further, in the same state, the second section 172 of the sheet member 170 is in contact with the fourth surface F4, the rear section F22 of the second surface F2, and the first inclined surface 162B of the recessed section 162. In addition, in the same state, the third section 173 of the sheet member 170 is in contact with the third surface F3, the front section F21 of the second surface F2, and the second inclined surface 162C of the recessed section 162.

As shown in FIG. 3, the stationary member 180 includes a protruding section 181 that is placed within the recessed section 162 of the base member 160 and fitted into the base member 160. The protruding section 181 includes a middle portion 181A, a first extension 181C, and a second extension 181C. The first extension 181B extends upward from a rear end of the middle portion 181A. The second extension 181C extends upward from a front end of the middle portion 181A. The middle portion 181A is formed in a plate shape perpendicular to the vertical direction. A length of the middle portion 181A in the left-to-right direction is substantially the same as the length of the base member 160 in the left-to-right direction. A length of the middle portion 181A in the front-to-rear direction is substantially the same as the length of the bottom surface 162A of the base member 160 in the front-to-rear direction. The middle portion 181A has three pedestals 185 for fixedly fastening the stationary member 180 to the base member 160 via the screws 186. The three pedestals 185 are arranged at regular intervals in the left-to-right direction.

As shown in FIG. 4, the first extension 181B is formed in the shape of a plate extending along the first inclined surface 162B of the base member 160. The first extension 181B has a first facing surface 182 that is opposed to the first inclined surface 162B. The second extension 181C is formed in the shape of a plate extending along the second inclined surface 162C of the base member 160. The second extension 181C has a second facing surface 183 that is opposed to the second inclined surface 162C. Each of the first and second facing surfaces 182 and 183 is preferred to be parallel to a corresponding one of the first and second inclined surfaces 162B and 162C. Nonetheless, each of the first and second facing surfaces 182 and 183 may be inclined with respect to the corresponding one of the first and second inclined surfaces 162B and 162C. The stationary member 180 may be made of metal or heat-resistant resin.

Figure 5A:
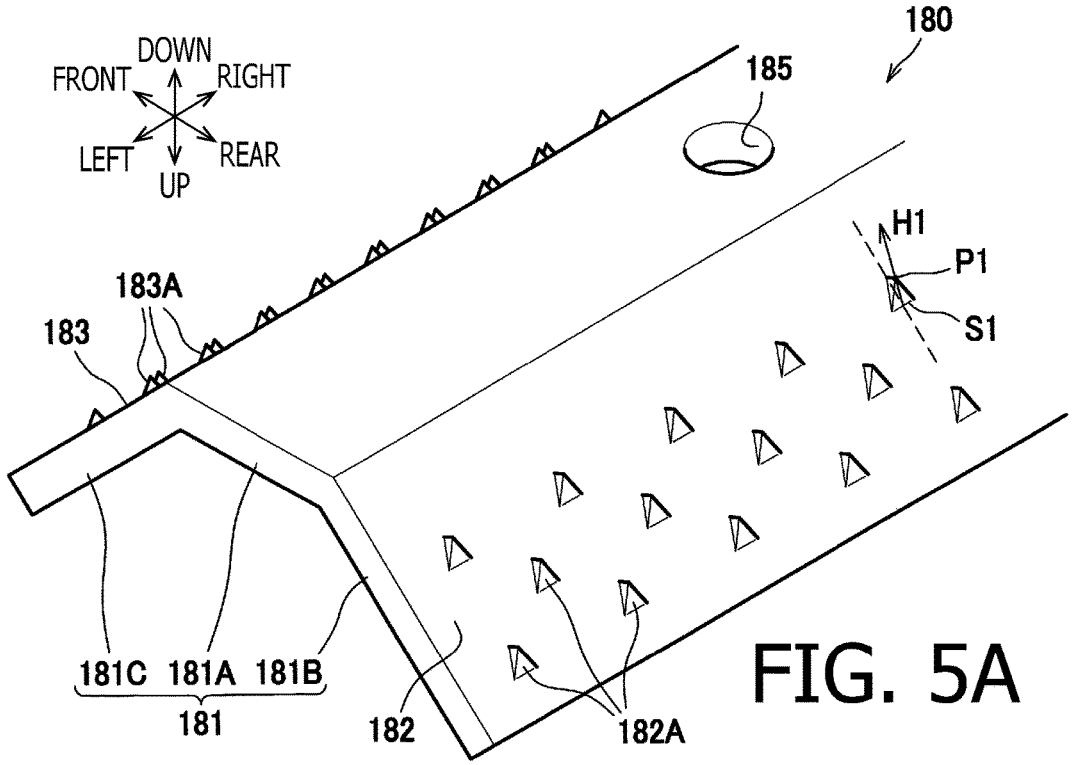
FIG. 5A is a perspective view of the stationary member in the illustrative embodiment according to one or more aspects of the present disclosure.

On the first facing surface 182, a plurality of first claws 182A are arranged. The first claws 182A are configured to engage with the second section 172 of the sheet member 170 within the recessed section 162. More specifically, the first claws 182A are configured to stick in the second section 172 of the sheet member 170 within the recessed section 162. As shown in FIG. 5A, there are three rows each including a plurality of first claws 182A arranged at regular intervals in the left-to-right direction. The three rows are arranged at regular intervals in the front-to-rear direction. Each first claw 182A is disposed in a center position between a corresponding two of adjacent first claws 182A of an adjacent row, in the left-to-right direction. Namely, the first claws 182A are arranged in a zigzag manner such that each two of mutually-adjacent first claws 182A are positionally different from each other in each of the left-to-right direction (i.e., the direction of the rotational axis of the endless belt 110) and the front-to-rear direction (i.e., a direction perpendicular to the rotational axis of the endless belt 110).

Each first claw 182A is formed in the shape of a triangle with a sharply pointed tip by press working to cut and raise a part of a metal plate. The cut and raised triangle has a vertex P1 directed toward the middle portion 181A. Namely, each first claw 182A is formed by cutting and raising two sides defining the vertex P1. A first direction H1 in which each first claw 182A extends is defined as a direction toward the vertex P1 from a midpoint of an opposite side S1 of the vertex P1. The first direction H1 is inclined with respect to the first inclined surface 162B (see FIG. 4). A height (i.e., a protruding amount of each first claw 182A) up to the tip of each first claw 182A from the first facing surface 182 is smaller than a thickness of the sheet member 170.

On the second facing surface 183, a plurality of second claws 183A are arranged. The second claws 183A are configured to engage with the third section 173 of the sheet member 170 within the recessed section 162. More specifically, the second claws 183A are configured to stick in the third section 173 of the sheet member 170 within the recessed section 162. There are three rows each including a plurality of second claws 183A arranged at regular intervals in the left-to-right direction. The three rows are arranged at regular intervals in the front-to-rear direction. Each second claw 183A is disposed in a center position between a corresponding two of adjacent second claws 183A of an adjacent row, in the left-to-right direction. Namely, the second claws 183A are arranged in a zigzag manner such that each two of mutually-adjacent second claws 183A are positionally different in each of the left-to-right direction and the front-to-rear direction.

Figure 5B:
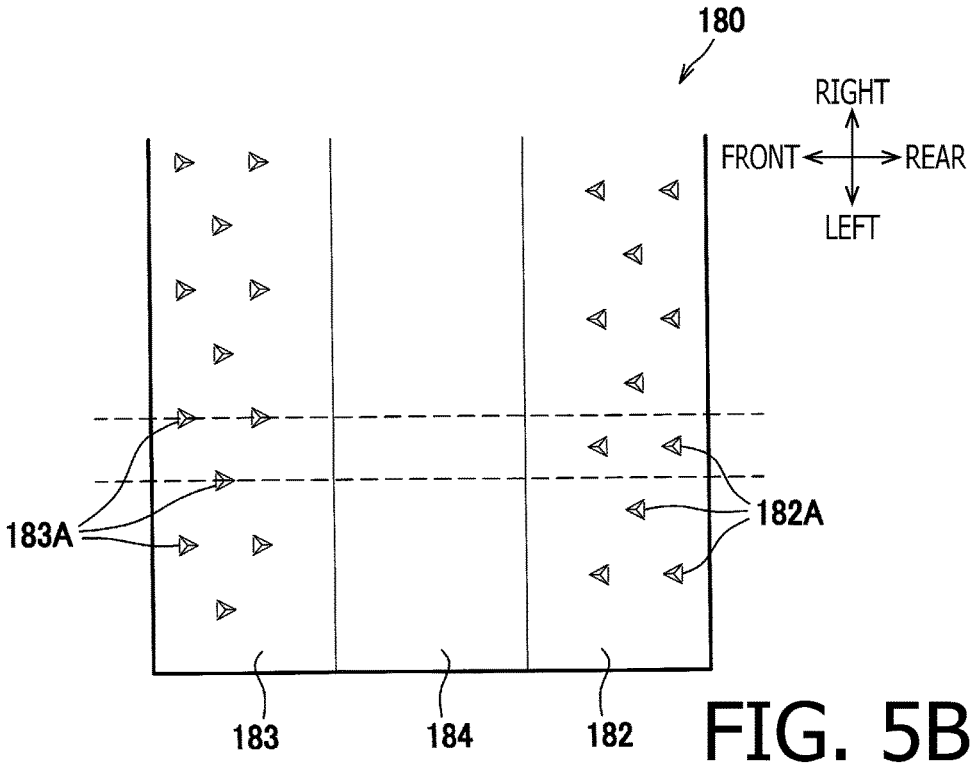
FIG. 5B is a bottom view of the stationary member in the illustrative embodiment according to one or more aspects of the present disclosure.

As shown in FIG. 5B, the second claws 183A are disposed in respective positions that are shifted (e.g., leftward) from the positions of the first claws 182A in the left-to-right direction (i.e., the direction of the rotational axis of the endless belt 110). Each second claw 183A is disposed in a middle position between a corresponding two of adjacent first claws 182A in the left-to-right direction.

The second claws 183A are formed in the same manner as the first claws 182A. Therefore, an explanation of how to form the second claws 183A will be omitted. A second direction H2 in which each second claw 183A extends is defined as a direction toward a vertex P1 from a midpoint of an opposite side S1 of the vertex P1. The second direction H2 is inclined with respect to the second inclined surface 162C (see FIG. 4).

As shown in FIG. 4, in a state where the sheet member 170 is fixedly fastened to the base member 160 by the stationary member 180, the first claws 182A stick in the sheet member 170 and engage with an end portion of the second section 172. Likewise, the second claws 183A stick in the sheet member 170 and engage with an end portion of the third section 173. In a cross-section perpendicular to the rotational axis of the endless belt 110, a length of the sheet member 170 from a stuck portion of the second section 172 in which the first claws 182A stick to a stuck portion of the third section 173 in which the second claws 183A stick is shorter than an outer circumferential length of the base member 160. The outer circumferential length of the base member 160 is a sum of lengths of the first surface F1, the third surface F3, the fourth surface F4, the front section F21 of the second surface F2, the rear section F22 of the second surface F2, the bottom surface 162A of the recessed section 162, the first inclined surface 162B of the recessed section 162, and the second inclined surface 162C of the recessed section 162.

Figure 6A:
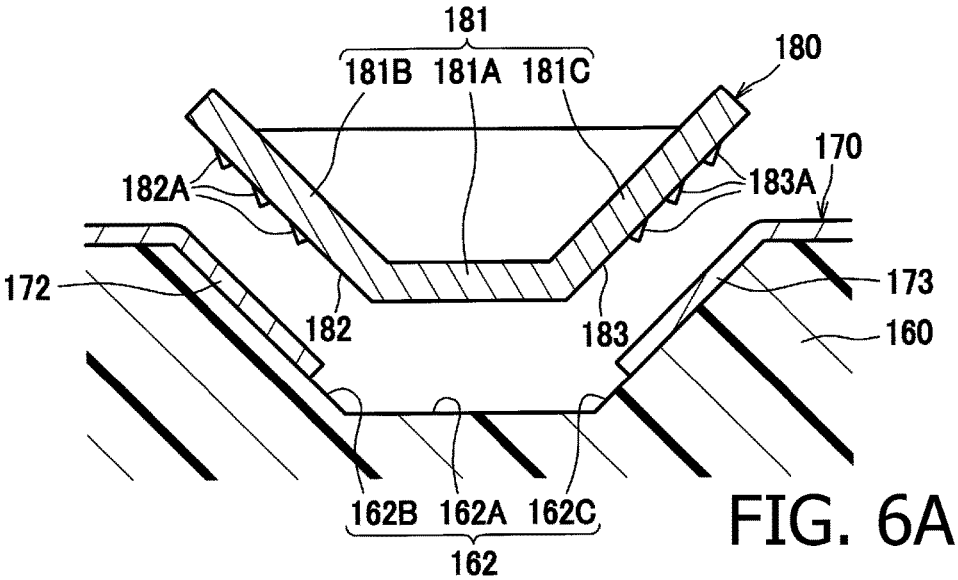
FIG. 6A shows a state where the stationary member is about to be placed onto the base member, in the illustrative embodiment according to one or more aspects of the present disclosure.

Subsequently, a process to fixedly fastening the sheet member 170 to the base member 160 by the stationary member 180 will be described. As shown in FIG. 3, to fixedly fasten the stationary member 180 to the base member 160, first, the first section 171 of the sheet member 170 is set on and along the first surface F1 of the base member 160. Next, each first escape hole 172A of the second section 172 of the sheet member 170 is engaged with a corresponding one of the projections 164, and the end portion of the second section 172 is laid on and along the first inclined surface 162B. Subsequently, each second escape hole 173A of the third section 173 of the sheet member 170 is engaged with a corresponding one of the projections 164, and the end portion of the third section 173 is laid on and along the second inclined surface 162C (see FIG. 6A).

Figure 6B:
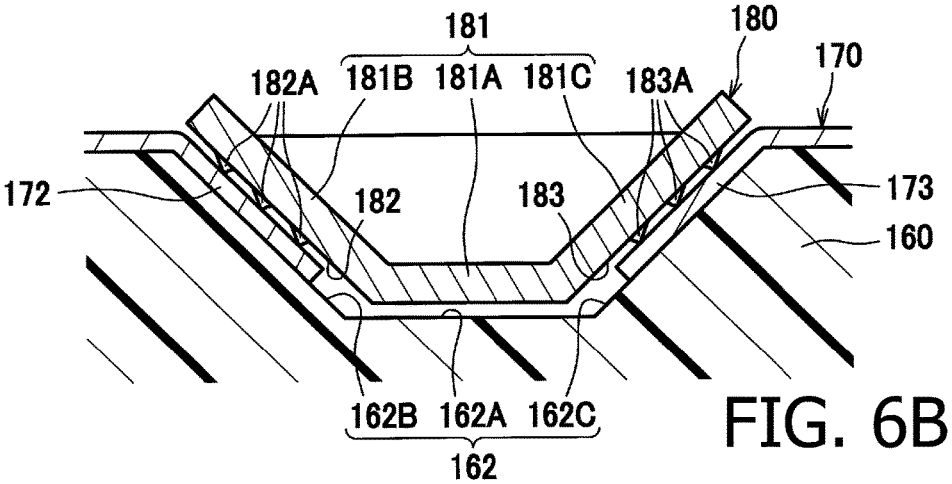
FIG. 6B shows a state where the stationary member is brought in contact with the sheet member, in the illustrative embodiment according to one or more aspects of the present disclosure.

Then, as shown in FIG. 6B, when the stationary member 180 is brought closer to the recessed section 162, the first claws 182A come into contact with the second section 172, and the second claws 183A come into contact with the third section 173.

Figure 6C:
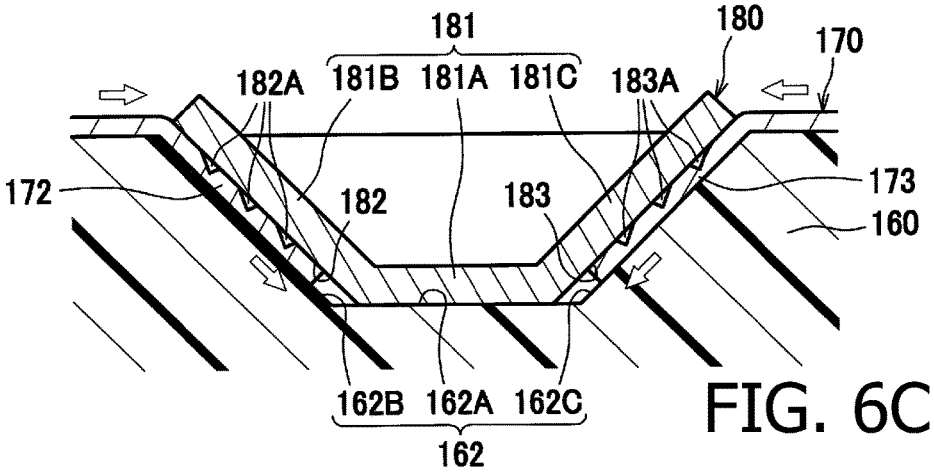
FIG. 6C shows a state where the stationary member is set onto the base member, in the illustrative embodiment according to one or more aspects of the present disclosure.

Then, as shown in FIG. 6C, when the stationary member 180 is fitted onto the base member 160 and pushed toward the bottom surface 162A, the first claws 182A stick in the sheet member 170 and engage with the second section 172, and the second claws 183A stick in the sheet member 170 and engage with the third section 173. When the stationary member 160 is pressed down until the middle portion 181A thereof comes into contact with the bottom surface 162A, the first claws 182A pull the second section 172 toward the bottom surface 162A, and the second claws 183A pull the third section 173 toward the bottom surface 162A. Afterward, when the stationary member 180 is fixedly fastened to the base member 160 via the screws 186, the sheet member 170 is maintained in a tension-applied state where the second section 172 and the third section 173 thereof are pulled toward the bottom surface 162A by the first claws 182A and the second claws 183A, respectively.

The illustrative embodiment provides the following advantageous effects. According to the illustrative embodiment, the second section 172 of the sheet member 170 engages with the first claws 182A of the stationary member 180. Further, the third section 173 of the sheet member 170 engages with the second claws 183A of the stationary member 180. The first claws 182A and the second claws 183A are positioned within the recessed section 162. Thus, the stationary member 180 may fixedly fasten, to the base member 160, the sheet member 170 in a tension-applied state where the second section 172 and the third section 173 of the sheet member 170 are pulled into the recessed section 162. Moreover, since the first claws 182A stick in the second section 172, and the second claws 183A stick in the third section 173, it is possible to prevent the sheet member 170 fixedly fastened to the base member 160, from easily loosing.

Further, each of the second claws 183A is disposed in a different position from any of the first claws 182A in the direction of the rotational axis of the endless belt 110. Therefore, when the first claws 182A and the second claws 183A stick in the sheet member 170, forces applied to the sheet member 170 are dispersed. Thereby, the sheet member 170 is prevented from being easily broken.

Further, the first inclined surface 162B is opposed to the first facing surface 182. The second inclined surface 162C is opposed to the second facing surface 183. The protruding section 181 is fitted into the recessed section 162. Therefore, the base member 160 may stably hold the stationary member 180.

Further, the first inclined surface 162B is inclined relative to the fitting direction (i.e., the vertical direction) in which the stationary member 180 is fitted onto the base member 160. The second inclined surface 162C is inclined relative to the fitting direction. Therefore, by moving the stationary member 180 in the fitting direction when the stationary member 180 is fitted onto the base member 160, the sheet member 170 is pulled along the first inclined surface 162B and the second inclined surface 162C. Hence, each of the claws 182A and 183A may easily pull the sheet member 170. Thus, the sheet member 170 is stably and fixedly fastened to the base member 160 in a tension-applied state (in which a tensile force is being applied to the sheet member 170).

The first claws 182A are arranged in a zigzag manner. The second claws 183A are arranged in a zigzag manner. Hence, each of the claws 182A and 183A may stick in the sheet member 170 with an even force. Thus, the sheet member 170 is certainly and fixedly fastened to the base member 160.

The height (i.e., the protruding amount of each first claw 182A) up to the tip of each first claw 182A from the first facing surface 182 is less than the thickness of the sheet member 170. Likewise, the height (i.e., the protruding amount of each second claw 183A) up to the tip of each second claw 183A from the second facing surface 183 is less than the thickness of the sheet member 170. Hence, it is possible to prevent any of the claws 182A and 183A from penetrating through the sheet member 170. Thereby, the sheet member 170 is prevented from being easily broken.

Hereinabove, the illustrative embodiment according to aspects of the present disclosure has been described. The present disclosure can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present disclosure. However, it should be recognized that the present disclosure can be practiced without reapportioning to the details specifically set forth. In other instances, well known processing structures have not been described in detail, in order not to unnecessarily obscure the present disclosure.

Only an exemplary illustrative embodiment of the present disclosure and but a few examples of its versatility are shown and described in the present disclosure. It is to be understood that the present disclosure is capable of use in various other combinations and environments and is capable of changes or modifications within the scope of the inventive concept as expressed herein. For instance, according to aspects of the present disclosure, the following modifications are possible. In the following description, with respect to each element having substantially the same configuration as exemplified in the aforementioned illustrative embodiment, the same reference character will be provided thereto, and an explanation thereof will be omitted.

First Modification

In the aforementioned illustrative embodiment, the first claws 182A of the stationary member 180 stick in an end portion (i.e., an end portion of the second section 172) of the sheet member 170 placed along and around the base member 160. Likewise, the second claws 183A of the stationary member 180 stick in an opposite end portion (i.e., an end portion of the third section 173) of the sheet member 170 placed along and around the base member 160. Nonetheless, one of the end portions of the sheet member 170 may be fixed to the base member 160. In this case, claws of the stationary member 180 may stick in the other end portion of the sheet member 170.

Figure 7:
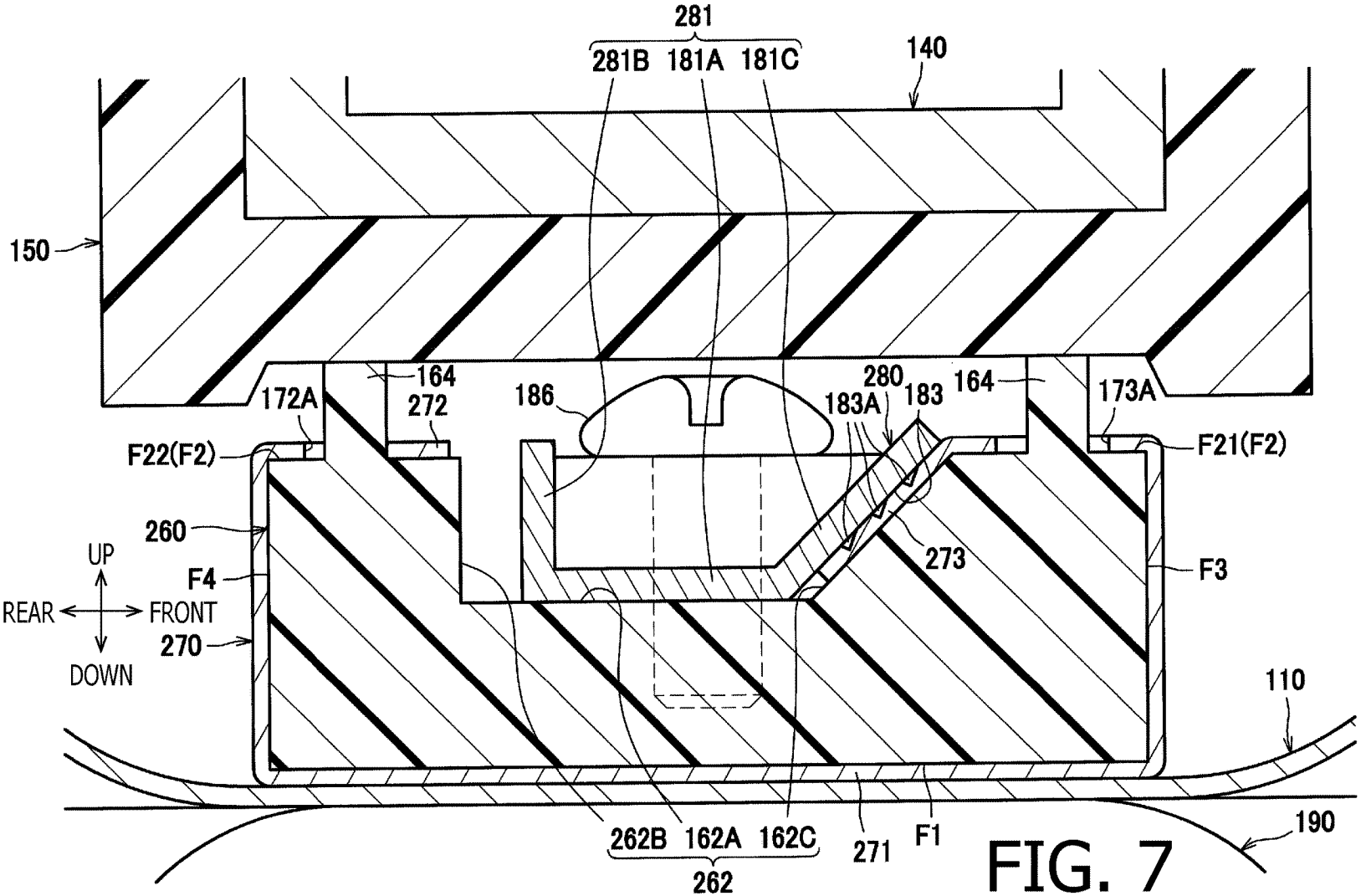
FIG. 7 is an enlarged cross-sectional side view showing a base member and its peripheral elements in a first modification according to one or more aspects of the present disclosure.

For instance, as shown in FIG. 7, a fuser of a first modification according to aspects of the present disclosure may include a base member 260, a sheet member 270, and a stationary member 280 that have different configurations from the corresponding elements 160, 170, and 180 exemplified in the aforementioned illustrative embodiment, respectively.

A recessed section 262 of the base member 260 has the bottom surface 162A and the second inclined surface 162C. A first side surface 262B vertically extends toward the second surface F2 from a rear end of the bottom surface 162A.

The sheet member 270 includes a first section 271, a second section 272, and a third section 273. The first section 271 is pinched between the endless belt 110 and the first surface F1. The second section 272 extends from a rear end of the first section 271. The third section 273 extends from a front end of the first section 271. The second section 272 is shorter than the second section 171 exemplified in the aforementioned illustrative embodiment, and does not reach the recessed section 262 of the base member 260.

A protruding section 281 of the stationary member 280 includes the middle portion 181A and the second extension 181C. On a facing surface of the second extension 181C, the second claws 183A are arranged. The protruding section 281 further includes a first extension 281B. The first extension 281B vertically extends toward the second surface F2 from a rear end of the middle section 181A. The first extension 281B has no claws.

Each of the projections 164 is inserted through a corresponding one of the first escape holes 172A of the second section 272. Thus, the second section 272 is locked by the base member 160.

The claws 183A of the stationary member 280 stick in the third section 273 of the sheet member 270 within the recessed section 262. In a cross-section perpendicular to the rotational axis of the endless belt 110, a length of the sheet member 270 from a locked portion of the second section 272 that is locked by the rear-side projections 164 of the base member 260 to a stuck portion of the third section 273 in which the claws 183A stick is shorter than an outer circumferential length of the base member 260. The outer circumferential length of the base member 260 is a sum of lengths of the first surface F1, the third surface F3, the fourth surface F4, the front section F21 of the second surface F2, the rear section F22 of the second surface F2, the bottom surface 162A of the recessed section 262, the first side surface 262B of the recessed section 262, and the second inclined surface 162C of the recessed section 262.

In the first modification, the third section 273 of the sheet member 270 is stuck in by the claws 183A within the recessed section 262 in a state where the first escape holes 172A of the second section 272 of the sheet member 270 are locked by the rear-side projections 164 of the base member 260. Therefore, the stationary member 280 may fixedly fasten, to the base member 260, the sheet member 270 in a tension-applied state where the third section 273 of the sheet member 270 is pulled into the recessed section 262. Further, the second claws 183A stick in the third section 273. Thereby, the sheet member 207 is prevented from easily slacking.

Second Modification

In the aforementioned illustrative embodiment, the first claws 182A and the second claws 183A of the stationary member 180 stick in respective end portions of the second section 172 and the third section 173 of the sheet member 170 placed along and around the base member 160. Nonetheless, a sheet member may have an overlapping section at which two end portions of the sheet member overlap each other. In this case, claws of a stationary member may stick in the overlapping section.

Figure 8:
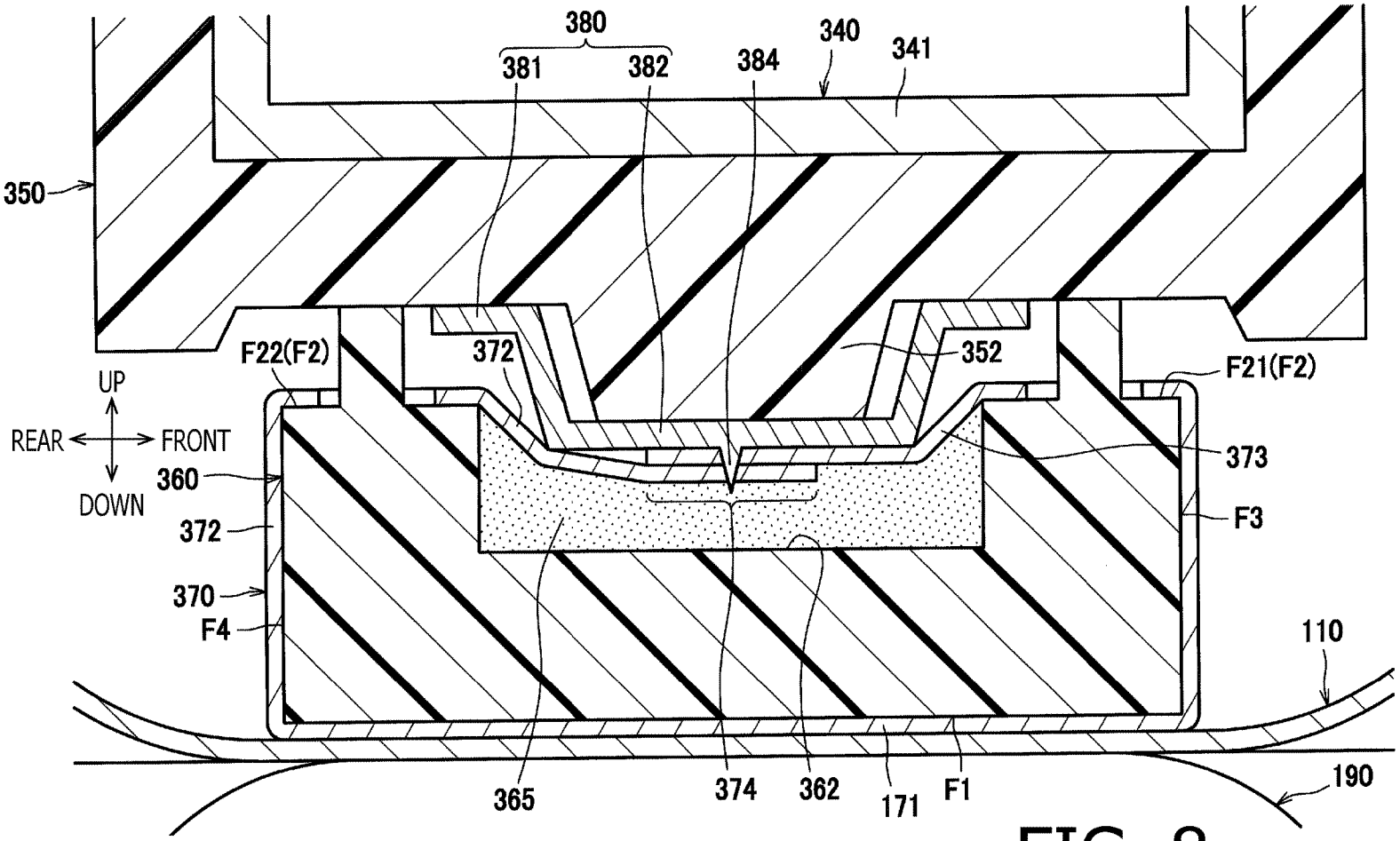
FIG. 8 is an enlarged cross-sectional side view showing a base member and its peripheral elements in a second modification according to one or more aspects of the present disclosure.

For instance, as shown in FIG. 8, a fuser of a second modification according to aspects of the present disclosure may include a heat insulator 350, a base member 360, a sheet member 370, and a stationary member 380 that have different configurations from the corresponding elements 150, 160, 170, and 180 exemplified in the aforementioned illustrative embodiment, respectively.

The base member 360 has the first surface F1 and the second surface F2. The first surface F1 is configured to pinch the sheet member 370 with the endless belt 110. The second surface F2 is a different surface from the first surface F1. At a middle portion of the second surface F2 in the front-to-rear direction, a recessed section 362 is formed. The recessed section 362 is filled with a compressible backup member 365 such as a sponge.

The sheet member 370 includes a second section 372 and a third section 373 that are longer than the corresponding elements 172 and 173 exemplified in the aforementioned illustrative embodiment, respectively. The sheet member 370 further includes an overlapping section 374 at which the third section 373 overlaps the second section 372.

The heat insulator 350 includes a pressing section 352 that protrudes downward. The pressing section 352 is configured to contact and press down the stationary member 380, thereby fixing the stationary member 380.

The stationary member 380 includes a flat section 381 and a protruding section 382. The protruding section 382 protrudes downward from the flat section 381. The protruding section 382 is disposed in the recessed section 362. The protruding section 382 has a plurality of claws 384 positioned at a middle portion of the protruding section 382 in the front-to-rear direction. The claws 384 are arranged at regular intervals in the left-to-right direction.

Each claw 384 extends downward and has a sharply pointed tip. The claws 384 are disposed within the recessed section 362. The claws 384 stick in the overlapping section 374 of the sheet member 372. When the stationary member 380 is attached to the base member 360, the claws 384 positioned above the backup member 365 stick into and engage with the overlapping section 374. Then, the protruding section 382 and the claws 384 press the overlapping section 374 downward. Thereby, the backup member 365 is compressed, and the overlapping section 374 is pressed down into the recessed section 362. When the overlapping section 374 is put into the recessed section 362, the sheet member 370 is brought into a tension-applied state where the second section 372 and the third section 373 are pulled into the recessed section 362. The stationary member 380 is fixedly fastened by the pressing section 352 of the heat insulator 350.

In a cross-section perpendicular to the rotational axis of the endless belt 110, a length of the sheet member 370 from a stuck portion of the second section 372 in which the claws 384 stick to a stuck portion of the third section 373 in which the claws 384 stick is shorter than an outer circumferential length of the base member 360. The outer circumferential length of the base member 360 is a sum of lengths of the first surface F1, the third surface F3, the fourth surface F4, the front section F21 of the second surface F2, the rear section F22 of the second surface F2, and an inner surface of the recessed section 362.

In the second modification, the claws 384 stick in the overlapping section 374 at which the second section 372 and the third section 373 overlap each other. Therefore, the stationary member 380 may fixedly fasten, to the base member 360, the sheet member 370 in a tension-applied state where the second section 372 and the third section 373 are pulled into the recessed section 362.

Third Modification

Figure 9:
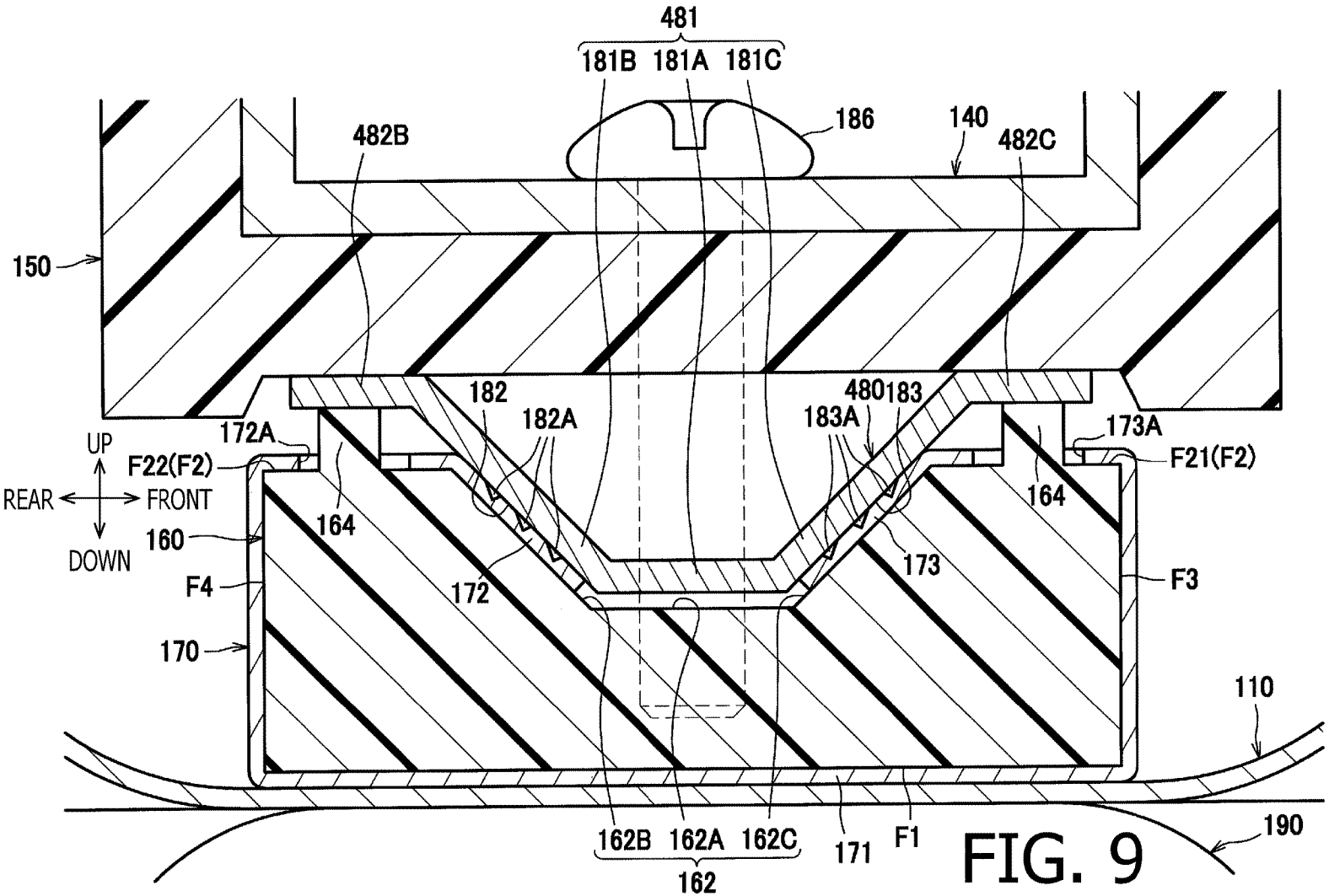
FIG. 9 is an enlarged cross-sectional side view showing a base member and its peripheral elements in a third modification according to one or more aspects of the present disclosure.

In the aforementioned illustrative embodiment, the stationary member 180 is fixedly fastened to the base member 160. Nonetheless, a stay may be fixed to a base member. For instance, as shown in FIG. 9, a stationary member 480 of a third modification according to aspects of the present disclosure may include a first horizontal portion 482B and a second horizontal portion 482C. The first horizontal portion 482B extends rearward from an end of the first extension 181B that is opposite to the middle portion 181A. The second horizontal portion 482C extends frontward from an end of the second extension 181C that is opposite to the middle portion 181A. The first horizontal portion 482B extends over upper surfaces of the front-side projections 164. The first horizontal portion 482B is pinched between the upper surfaces of the front-side projections 164 and the heat insulator 150. The second horizontal portion 482C extends over upper surfaces of the rear-side projections 164. The second horizontal portion 482C is pinched between the upper surfaces of the rear-side projections 164 and the heat insulator 150. The heat insulator 150 is pinched between the stationary member 480 and the stay 140. The stay 140 pinches the stationary member 480 and the heat insulator 150 with the base member 160, thereby supporting the stationary member 480 and the heat insulator 150. The stay 140 is fixedly fastened to the base member 160 with the screws 186.

Figure 10A:
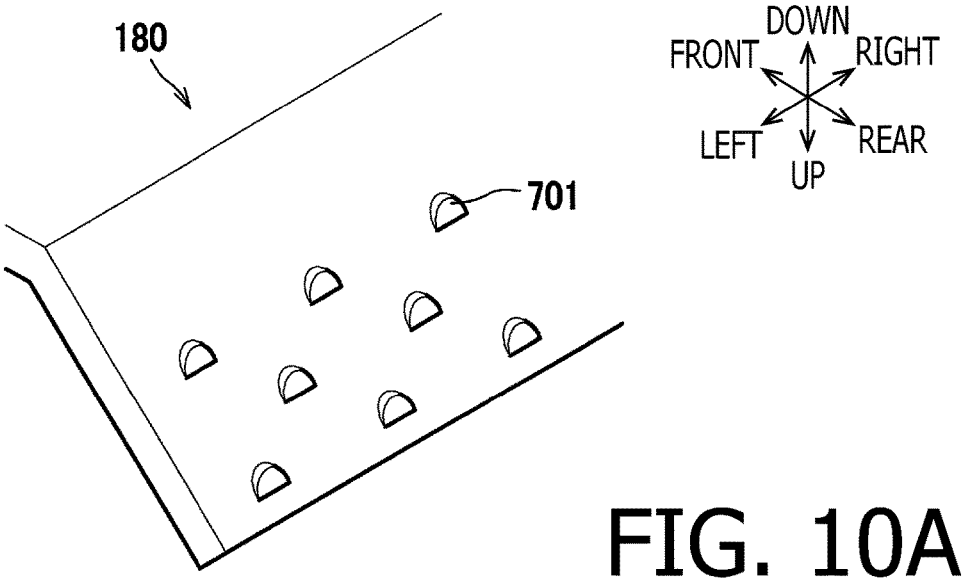
FIG. 10A is a perspective view showing a stationary member having claws each cut and raised in a semi-circular shape, in a modification according to one or more aspects of the present disclosure.

In the aforementioned illustrative embodiment, each of the claws 182A and 183A is formed in a triangle shape by cutting and raising a part of a metal plate. Nonetheless, for instance, as shown in FIG. 10A, the stationary member 180 may have claws 701 cut and raised in a semi-circular shape.

Figure 10B:
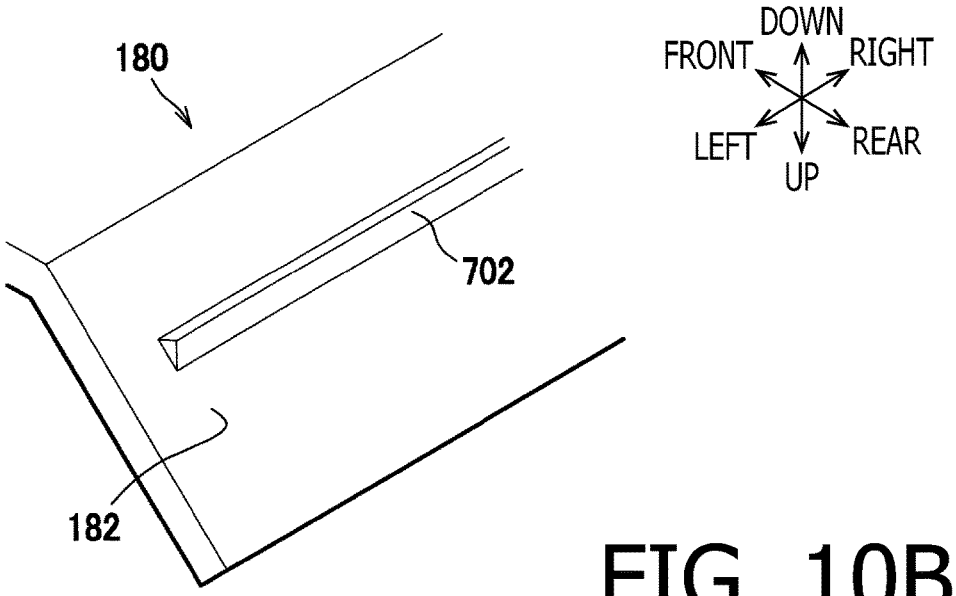
FIG. 10B is a perspective view showing a stationary member having a single claw in a modification according to one or more aspects of the present disclosure.

In the aforementioned illustrative embodiment, the stationary member 180 has a plurality of claws on each of the first and second facing surfaces 182 and 183. Nonetheless, for instance, as shown in FIG. 10B, the stationary member 180 may have only a single claw 702 extending along the left-to-right direction on the first facing surface 182.

In the aforementioned illustrative embodiment, the protruding amount of each of the claws 182A and 183A is smaller than the thickness of the sheet member 170. Nonetheless, the protruding amount of each of the claws 182A and 183A may be equal to or larger than the thickness of the sheet member 170.

In the aforementioned illustrative embodiment, the base member 160 is made of resin. Nonetheless, the base member 160 may be made of material (e.g. metal) other than resin.

In the aforementioned illustrative embodiment, the second surface F2 at which the recessed section 162 is formed is a surface opposite to the first surface F1 that pinches the sheet member 170 with the endless belt 110. Nonetheless, the second surface F2 at which the recessed section 162 is formed may only need to be a surface different from the first surface F1. For instance, the second surface F2 at which the recessed section 162 is formed may be a side surface adjacent to a front or rear end of the first surface F1.

In the aforementioned illustrative embodiment, the stationary member 180 is fixedly fastened to the base member 160 via the three screws 186 that are arranged at regular intervals in the left-to-right direction. Nonetheless, the screws 186 may not be arranged at regular intervals. Further, the number of the screws 186 may be one, two, four or more.

In the aforementioned illustrative embodiment, the stationary member 180 is fixedly fastened to the base member 160 via the screws 186. Nonetheless, the stationary member 180 may be fixed to the base member 160 in other methods. For instance, each projection 164 of the base member 160 may be extended and engaged with the stationary member 180. Further, in this case, the stationary member 180 may be fixed to the base member 160 by swaging an end portion of each extended projection 164.

In the aforementioned illustrative embodiment, the halogen lamp 120 is exemplified as a heat source. Nonetheless, for instance, a carbon heater or an induction heating type heater may be used as a heat source.

Examples of the sheets P used as recording media for the laser printer 1 may include thick papers, cardboards, postcards, thin papers, tracing paper, transparencies, and OHP sheets, as well as regular papers.

In the aforementioned illustrative embodiment, the pressurizing roller 190 is used as a pressurizing member to be pressed against the base member 160. Nonetheless, a pressurizing belt may be used instead of the pressurizing roller 190. Further, the base member 160 may be disposed on an inner side of (i.e., may be placed inside a space surrounded by) an endless pressurizing belt, which may contact a heating roller with a halogen lamp contained therein.

With respect to associations of elements exemplified in the aforementioned illustrative embodiment and modifications with elements to be defined according to aspects of the present disclosure, the sheet P may be an example of a "recording sheet" according to aspects of the present disclosure. The fuser 100 may be an example of a "fuser" according to aspects of the present disclosure. The process unit 4 may be an example of a "process unit" according to aspects of the present disclosure. The toner may be an example of "developer" according to aspects of the present disclosure. The first inclined surface 162B may be an example of a "side surface" according to aspects of the present disclosure. The second inclined surface 162C may be an example of the "side surface" according to aspects of the present disclosure. The first facing surface 182 may be an example of a "particular surface" according to aspects of the present disclosure. The second facing surface 183 may be an example of the "particular surface" according to aspects of the present disclosure. The projections 164 may be an example of a "locking section" according to aspects of the present disclosure.

What is claimed is:

1. A fuser comprising:

an endless belt;

a base member disposed inside a space surrounded by the endless belt;

a sheet member including:

a first section pinched between an inner surface of the endless belt and the base member;

a second section extending from an end of the first section; and a third section extending from another end of the first section; and a stationary member configured to pinch the second section and the third section of the sheet member with the base member, the stationary member having a claw configured to stick in the second section and the third section of the sheet member.

2. The fuser according to claim 1, wherein in a cross-section perpendicular to a rotational axis of the endless belt, a length of the sheet member from a stuck portion of the second section in which the claw sticks to a stuck portion of the third section in which the claw sticks is shorter than an outer circumferential length of the base member.

3. The fuser according to claim 1, wherein the base member includes a recessed section, and wherein the claw sticks in the second section and the third section of the sheet member in the recessed section.

4. The fuser according to claim 1, wherein a plurality of the claws include:

a first claw configured to stick in the second section of the sheet member and not stick in the third section of the sheet member; and a second claw configured to stick in the third section of the sheet member and not stick in the second section of the sheet member, the second claw being disposed in a position different from the first claw when viewed in a direction of a rotational axis of the endless belt.

5. The fuser according to claim 4, wherein the stationary member includes:

a plurality of the first claws disposed in the direction of the rotational axis of the endless belt; and a plurality of the second claws disposed in the direction of the rotational axis of the endless belt, each of the second claws being placed in a different position from any of the first claws in the direction of the rotational axis of the endless belt.

6. The fuser according to claim 1, wherein in the cross-section perpendicular to a rotational axis of the endless belt, a recessed section of the base member has:

a bottom surface; and a side surface extending from an end of the bottom surface, and wherein the claw extends in a first direction inclined relative to the side surface and sticks in the second section placed on the side surface.

7. The fuser according to claim 6, wherein the stationary member includes a protruding section configured to, when the claw sticks in the sheet member, be positioned in the recessed section of the base member, the protruding section having a particular surface facing the side surface, and wherein the claw is disposed on the particular surface facing the side surface.

8. The fuser according to claim 1, wherein the base member has a first surface and a second surface positioned on an opposite side of the base member from the first surface, wherein the first section of the sheet member is pinched between the inner surface of the endless belt and the first surface, and wherein the second section and the third section of the sheet member are pinched between the stationary member and the second surface.

9. The fuser according to claim 1, wherein the stationary member is fixed to the base member via one or more screws.

10. The fuser according to claim 1, further comprising a stay configured to support the stationary member by pinching the stationary member with the base member.

11. The fuser according to claim 4, wherein the plurality of the claws are arranged in a zigzag manner, each two of mutually-adjacent claws of the plurality of the claws being positionally different from each other in both the direction of the rotational axis of the endless belt and a direction perpendicular to the rotational axis.

12. The fuser according to claim 1, wherein a protruding amount of the claw is smaller than a thickness of the sheet member.

13. The fuser according to claim 1, wherein the sheet member includes an overlapping section at which the second section and the third section overlap each other, and wherein the claw sticks in the overlapping section of the sheet member.

14. A fuser comprising:

an endless belt;

a base member disposed inside a space surrounded by the endless belt;

a sheet member including:

a first section pinched between an inner surface of the endless belt and the base member;

a second section extending from an end of the first section, the second section being locked by a locking section of the base member; and a third section extending from another end of the first section; and a stationary member configured to pinch the third section of the sheet member with the base member, the stationary member having a claw configured to stick in the third section of the sheet member.

15. The fuser according to claim 14, wherein in a cross-section perpendicular to a rotational axis of the endless belt, a length of the sheet member from a locked portion of the second section that is locked by the locking section to a stuck portion of the third section in which the claw sticks is shorter than an outer circumferential length of the base member.

16. The fuser according to claim 14, wherein the base member includes a recessed section, and wherein the claw sticks in the third section of the sheet member in the recessed section.

17. The fuser according to claim 14, wherein in the cross-section perpendicular to a rotational axis of the endless belt, a recessed section of the base member has:

a bottom surface; and a side surface extending from an end of the bottom surface, and wherein the claw extends in a second direction inclined relative to the side surface and sticks in the third section placed on the side surface.

18. The fuser according to claim 14, wherein the base member has a first surface and a second surface positioned on an opposite side of the base member from the first surface, wherein the first section of the sheet member is pinched between the inner surface of the endless belt and the first surface, and wherein the third section of the sheet member is pinched between the stationary member and the second surface.

19. An image forming apparatus comprising:

a process unit comprising a developer container, the process unit being configured to form a developer image on a recording sheet with developer supplied from the developer container; and a fuser configured to fix the developer image onto the recording sheet, the fuser comprising:

an endless belt;

a base member disposed inside a space surrounded by the endless belt;

a sheet member including:

a first section pinched between an inner surface of the endless belt and the base member;

a second section extending from an end of the first section; and a third section extending from another end of the first section; and a stationary member configured to pinch the second section and the third section of the sheet member with the base member, the stationary member having a claw configured to stick in the second section and the third section of the sheet member.

20. An image forming apparatus comprising:

a process unit comprising a developer container, the process unit being configured to form a developer image on a recording sheet with developer supplied from the developer container; and a fuser configured to fix the developer image onto the recording sheet, the fuser comprising:

an endless belt;

a base member disposed inside a space surrounded by the endless belt;

a sheet member including:

a first section pinched between an inner surface of the endless belt and the first surface of the base member;

a second section extending from an end of the first section, the second section being locked by a locking section of the base member; and a third section extending from another end of the first section; and a stationary member configured to pinch the third section of the sheet member with the base member, the stationary member having a claw configured to stick in the third section of the sheet member.

* * * * *